United States Patent [19]

Shepherd

[11] Patent Number: 4,714,142

[45] Date of Patent: Dec. 22, 1987

[54] RAILWAY CAR HAND BRAKE WITH RELEASE GOVERNOR

[75] Inventor: Robert W. Shepherd, Hamburg, N.J.

[73] Assignee: Ellcon-National, Inc., Totowa, N.J.

[21] Appl. No.: 57,731

[22] Filed: Jun. 2, 1987

Related U.S. Application Data

[63] Continuation-in-part of Ser. No. 613,470, May 24, 1984, abandoned.

[51] Int. Cl.[4] ..... G05G 1/08; F16D 51/10

[52] U.S. Cl. ..... 188/185; 188/180; 188/250 A; 74/505

[58] Field of Search ..... 188/184, 185, 186, 190, 188/187, 250 R, 250 A; 192/8 A, 8 R; 74/505, 528, 411.5; 182/241; 254/357, 378, 376, 267

[56] References Cited

U.S. PATENT DOCUMENTS

| | | | |
|---|---|---|---|
| 1,190,483 | 7/1916 | Tibbals | 182/241 |
| 1,339,380 | 5/1920 | McCloud | 188/184 |
| 2,181,359 | 12/1939 | Barrett | 254/267 |
| 2,372,026 | 3/1945 | Smith | 192/8 R |
| 3,176,539 | 4/1965 | Mersereau | 74/505 |
| 3,529,488 | 9/1970 | Natschke | 74/505 |
| 3,796,289 | 3/1974 | Benjamin et al. | 188/185 |
| 3,979,969 | 9/1976 | O'Brien | 188/187 |
| 4,128,148 | 12/1978 | Schmitt | 188/197 |
| 4,182,197 | 1/1980 | Olander | 74/411.5 |

*Primary Examiner*—John W. Caldwell, Sr.
*Assistant Examiner*—Alvin Oberley
*Attorney, Agent, or Firm*—Brooks Haidt Haffner & Delahunty

[57] ABSTRACT

In a hand brake mechanism for railway cars in which a chain drum is rotatable by a manually rotatable shaft connected to the chain drum by a gear train, a centrifugal governor or brake connected to an intermediate gear of the gear train reduces the speed of rotation of the gears only after the force applied to the brakes has been substantially reduced, and hence even though the initial speed of rotation of the drum and the let-out speed of the chain when the brake is first released is substantially unaffected, the governor or brake is effective as the forces are reduced to substantially the forces of inertia of the brake mechanisms, the hand brake parts and the chain, so as to reduce the speeds of rotation of the hand brake parts to a small value and thereby prevent damage to and wear of the parts and increase the life of the hand brake mechanism.

13 Claims, 6 Drawing Figures

Fig. 1.
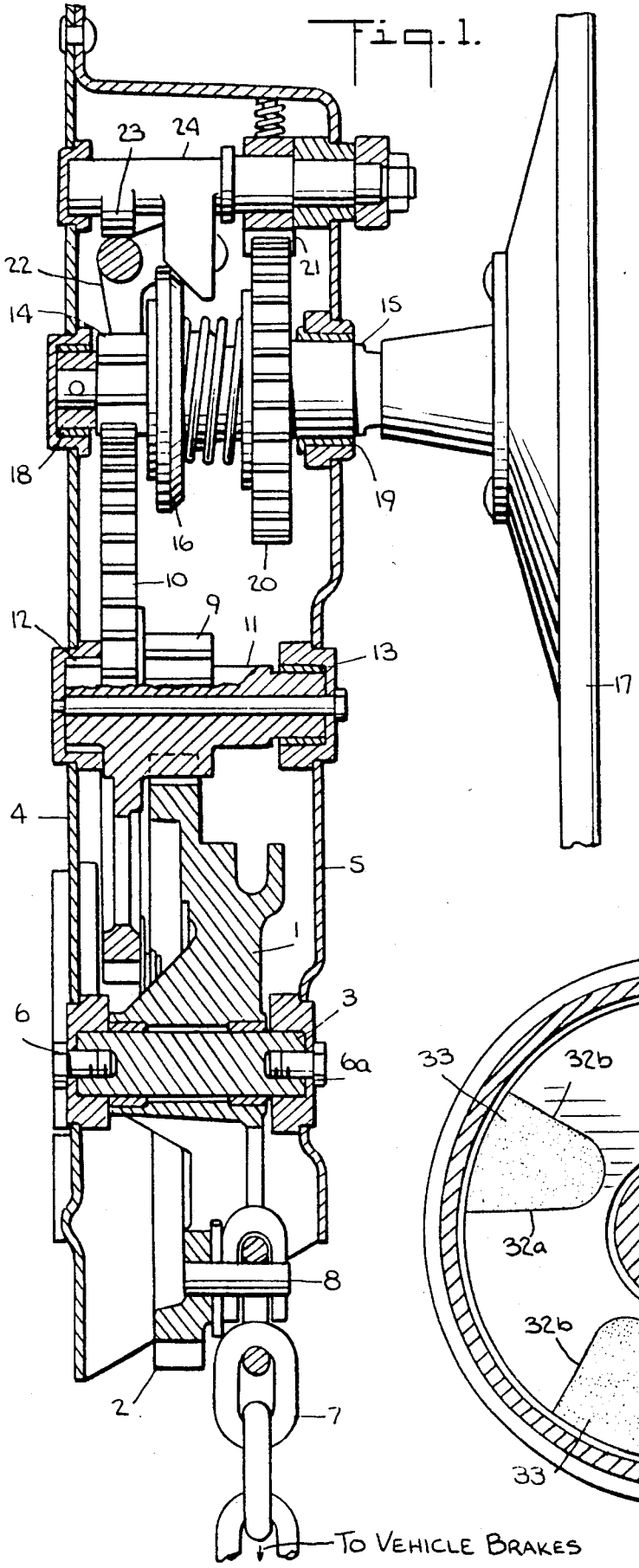
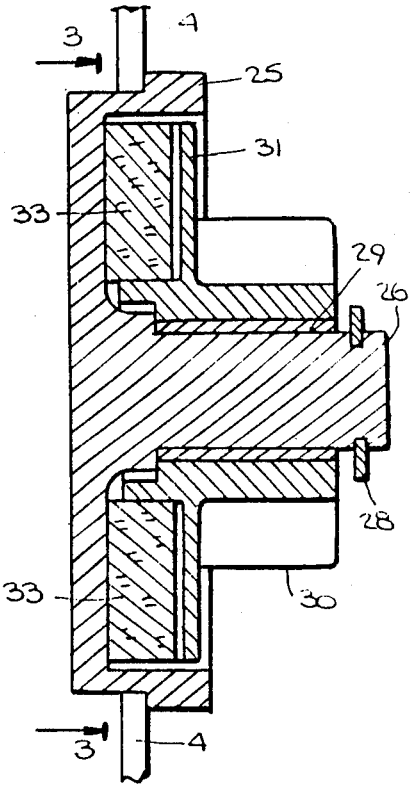
Fig. 4.
Fig. 3.
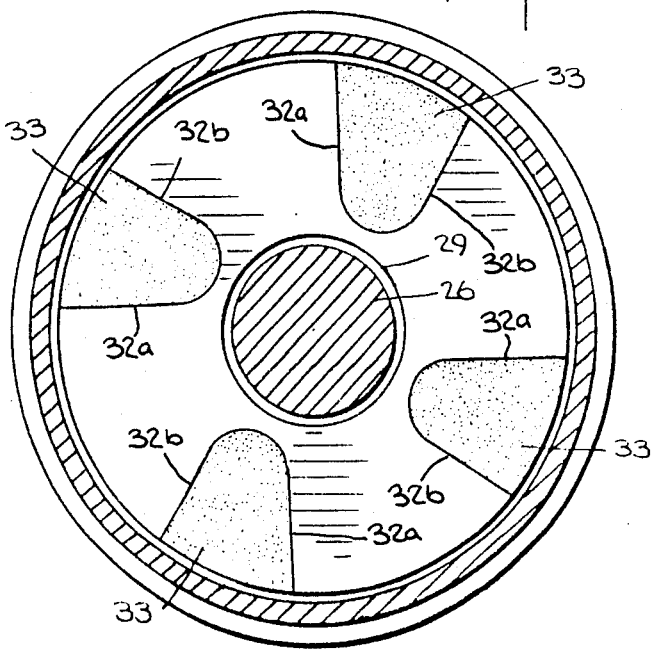

RAILWAY CAR HAND BRAKE WITH RELEASE GOVERNOR

This application is a continuation-in-part of my copending application Ser. No. 613,470 filed May 24, 1984, abandoned and entitled Railway Car Hand Brake with Release Governor.

This invention relates to hand operable brake mechanisms and particularly, to the hand brake mechanisms for railway cars.

Railway car hand brake mechanisms are well known in the art and usually include a large, rotatable hand wheel disposed in a vertical plane and mounted on a shaft which, through a gear train, can rotate a chain drum to wind up a chain which is secured at its end remote from the chain drum to the brake rigging of the railway car. As the hand wheel is rotated in one direction, the brakes are applied and rotation of the hand wheel shaft in the opposite direction is prevented by a pawl which engages a detent wheel on the hand wheel shaft.

The brakes may be released by disengaging the pawl from the detent wheel but this causes rapid rotation of the hand wheel and the gears of the gear train. To avoid rapid rotation of the hand wheel, hand brake mechanisms have been devised which are known as "quick release" mechanisms and which include releasable connecting means between the hand wheel shaft and the gear train. When the connecting means is released, the gears of the gear train rotate rapidly, without constraint by the pawl and detent wheel, but the hand wheel remains stationary.

The Association of American Railroads (AAR) promulgates specifications for the design and operation of railway car hand brake mechanisms. Vertical wheel, gear train, hand brake mechanisms are classified in three categories, namely:

(1) Standard power—provides an average force on the chain of 3350 lbs. with a 125 lb. turning force applied to the rim of a wheel twenty-two inches in diameter.

(2) Intermediate power—provides an average force on the chain of 4475 lbs. with a 125 lb. turning force applied to the rim of a wheel twenty-two inches in diameter.

(3) High power—provides an average force on the chain of 6800 lbs. with a 125 lb. turning force applied to the rim of a wheel twenty-two inches in diameter.

When the hand brake mechanism is released, after setting of the brakes, and the gears of the gear train rotate rapidly, the gears and other components are subjected to high forces and to shock, particularly, when the chain becomes fully let-out from the chain drum.

In recent times, the AAR has added a life cycle test to its specifications, and hand brake mechanisms which do not meet the life cycle test cannot be sold for use on railway cars operated in interchange service on United States railroads. The AAR life cycle test for quick release brakes requires that such latter brakes withstand 3000 quick release operations.

To meet such life cycle test requirements, even standard power hand brake mechanisms had to be modified when the life cycle test was adopted. When intermediate power hand brake mechanisms of the type sold prior to the adoption of the life cycle test were subjected to the life cycle test, it was found that the components thereof wore prematurely or were damaged, and it was found to be necessary to add a shock retarder, or absorber, external to the hand brake mechanism, to overcome such wear and damage. Of course, such an external shock retarder is undesirable not only because it is external to the hand brake mechanism but also because of the additional cost and because it requires field modification of the equipment on a railway car if the intermediate power hand brake mechanism is used to replace a standard power hand brake mechanism.

High power hand brake mechanisms sold prior to the adoption of the life cycle test were similarly unable to pass the life cycle test. It should be borne in mind that such high power brake mechanisms normally have additional gears to provide the desired force on the chain, and this results in a higher speed of rotation of at least some of the gears during release of the hand brake mechanism.

Although the use of an external shock retarder might have solved the problems with the higher power hand brake mechanism, a change in the AAR specifications would have been required to permit the use of such an external shock retarder. Attempts were made to redesign the high power hand brake mechanism, such as by making it stronger, so that it would meet the life cycle test without the use of an external shock retarder, but the attempts were not successful.

One of the characteristics of railway car brakes with which the invention is concerned is that the force applied to the chain, and hence, the parts of the hand brake, is non-linear and depends on the extent to which the brakes are applied or released. Thus, as the brakes are applied, relatively little force is required to take up the slack in the chain and the brake rigging, but to meet AAR requirements, the final force on the chain must be as set forth hereinbefore, namely, 3350 lbs. for a standard power brake, 4475 lbs. for an intermediate power brake and 6800 lbs. for a high power brake. After slack in the rigging is taken up, which may require, for example, 5–15 inches of chain travel, the force on the chain increases exponentially, e.g. from 200 lbs. to the final value, as the brake hand wheel is further turned to set the brakes. In reaching the final value after the slack is taken up, the chain may travel only two or three inches. Similarly, when the hand brake is released, the chain force decreases exponentially and reaches a relatively small value shortly after the hand brake is released.

Typical railway car brake mechanisms are illustrated in U.S. Pat. Nos. 3,543,889 and 4,128,148, and it will be observed that the chain extending from the hand brake drum is connected to the brake shoes at the wheels by levers and rods. After the brake shoes engage the wheels and the slack is taken up, the force of the chain causes bending of the levers and stretching of the rods. Thus, when the hand brake is released, the initial force on the chain is dissipated by the return of the levers and rods to their normal sizes or configuration. However, if let-out of the chain is discontinued when such force is dissipated, the brake shoes are not returned to the desired brake release positions. Accordingly, it is necessary to permit the chain to let-out after the high braking forces are dissipated.

When the hand brake is first released, the forces applied to the chain drum are relatively large and initially cause the chain drum and the gears to rotate rapidly. As soon as the large forces are discontinued, which may involve only a portion of the permitted rotation of the drum which latter may be only 270° of rotation, there is only a small force pulling the chain and restoring the rigging to the brake release position. However, due to the inertia of the hand brake gears, etc., the gears and the drum will continue to rotate rapidly until the chain is fully let-out which damages the gears, etc. For this reason, even though it is not necessary to retard the initial rotation of the parts of the hand brake mechanism, and in fact, it is undesirable if full brake release is to be attained, it is desirable to retard the rotation of the parts of the hand brake mechanism after the initial large braking force has been dissipated. On the other hand, the let-out of the chain should not be immediately brought to a full stop after such force has been dissipated if the desired full brake release is to be attained.

Accordingly, it has been found that to accomplish full brake release while avoiding damage to the parts of the hand brake mechanism, a braking force should be applied to one of the parts which is insignificant as compared to the forces which rotate the parts when the hand brake is first released but which is effective to overcome the forces of inertia after the braking force is dissipated and to bring the speed of rotation of the parts to at least low value at the time that the chain is fully let-out. To accomplish this, the hand brake of the invention includes a centrifugal brake which does not limit the initial rate of rotation of the hand brake parts but which, with smaller forces on the chain after the braking force is dissipated, is effective to retard the rate of rotation of the hand brake parts and decreases in effect as the rate of rotation of the parts decreases and the chain reaches full let-out. In other words, the centrifugal brake in the hand brake is not effective to set an upper limit on the rate of rotation of the parts of the hand brake, as distinguished from centrifugal brakes used for other purposes such as hoists where the load is constant and the speed of descent must be limited, but it is effective when the force on the chain is low to slow the rate of rotation of the hand brake parts but not to stop rotation thereof before the chain approaches full let-out.

One object of the present invention is to provide a hand brake mechanism which will pass the life cycle tests of the AAR without the use of an external shock retarder.

Another object of the invention is to provide a self-contained, quick release, hand brake mechanism which can withstand at least 3000 cycles of operation without damage or undue wear.

In accordance with the preferred embodiment of the invention, the hand wheel drives a gear train through a quick release mechanism and the gear train rotates a chain drum on which a chain, which connects to the brake rigging of a railway car, is wound up. A friction governor, or braking means, which applies a retarding force which is dependent upon the rate of rotation of the gears of the gear train but which is substantially ineffective to retard such rotation until after the braking force on the car brakes has been removed, is coupled to one of the intermediate gears so that the rate of rotation of the gears after the quick release mechanism is operated and the chain is substantially fully let-out is below a rate which would cause damage to, or undue wear of, the components of the hand brake mechanism when subjected to the AAR life cycle test.

Other objects and advantages of the present invention will be apparent from the following detailed description of the presently preferred embodiments thereof, which description should be considered in conjunction with the accompanying drawings in which:

FIG. 1 is a side elevation view, partly in cross-section, of the preferred embodiment of a hand brake mechanism incorporating the invention;

FIG. 3 is an enlarged, cross-sectional view of the braking means or governor forming part of the embodiment illustrated in FIGS. 1 and 2 and is taken along the lines 3—3 in FIG. 4;

FIG. 4 is a side elevation, cross-sectional view of the braking means or governor;

Figure 2:
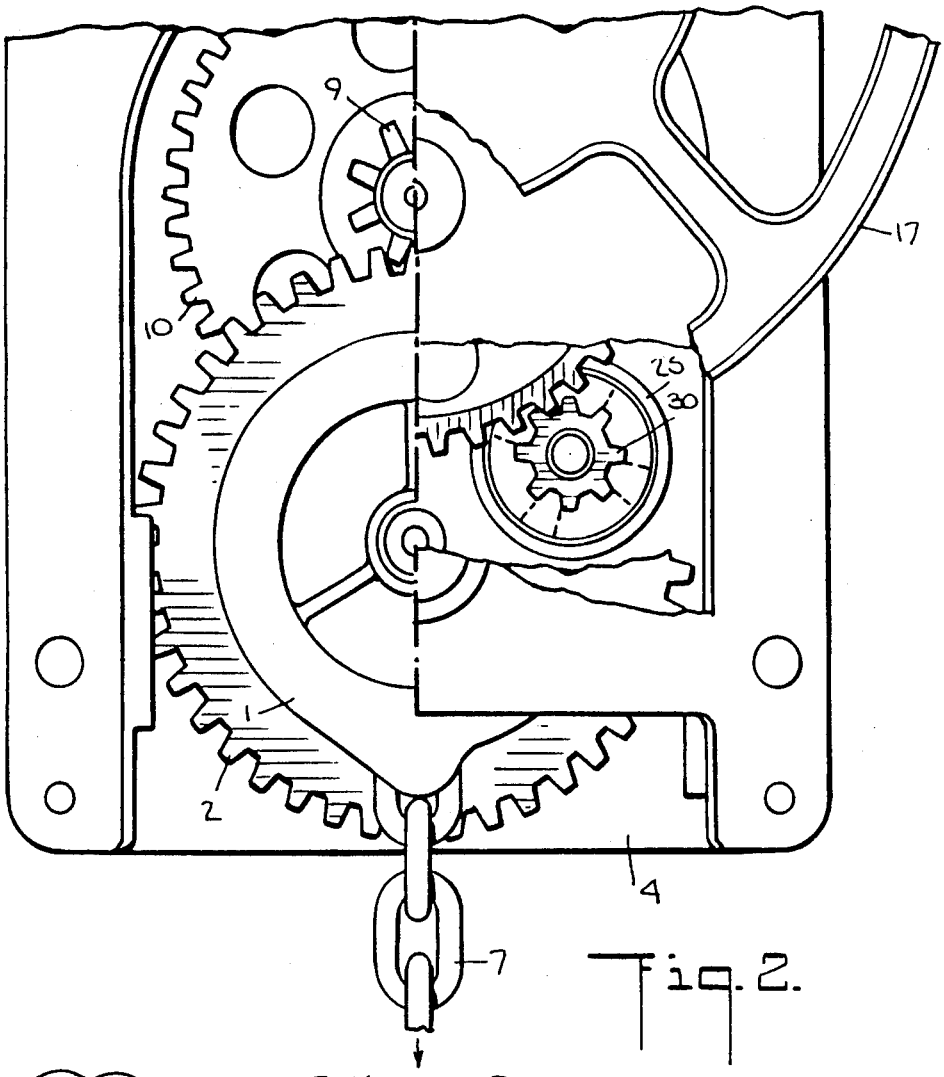
FIG. 2 is a fragmentary, front elevation view, with a portion of the cover cut away, of the embodiment illustrated in FIG. 1.
Figure 5:
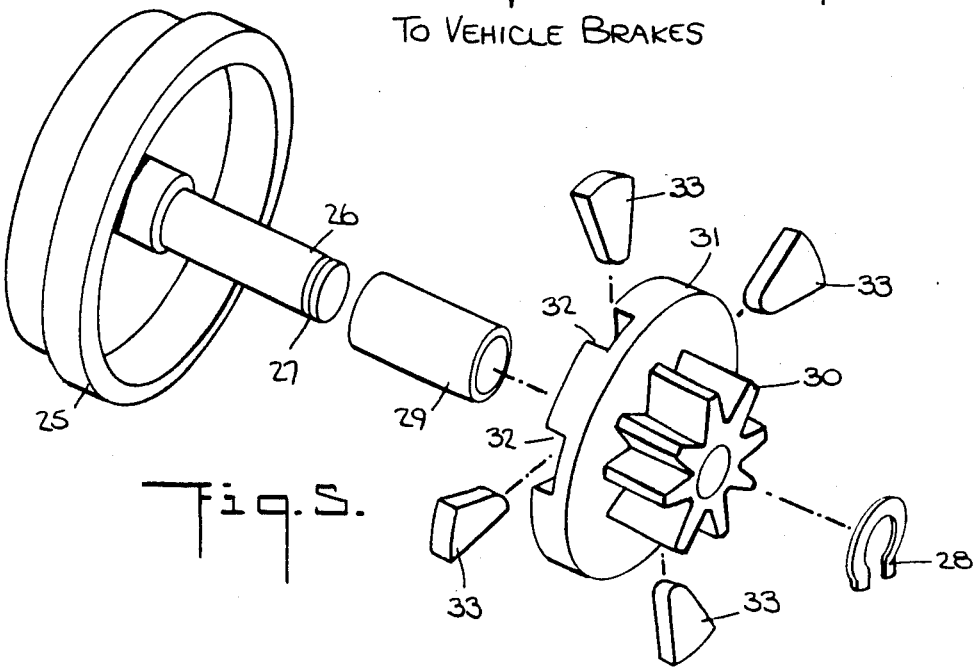
FIG. 5 is an exploded view of the braking means or governor.

Although the invention is applicable to standard power, intermediate power and high power hand brake mechanisms and although the invention may be used with hand brake mechanisms without quick release means, e.g. in which the brakes may be released by disengaging the pawl from the detent wheel on the hand wheel shaft and permitting the hand wheel to spin, the invention will be described in connection with a high power hand brake mechanism having both a quick release means and gradual release means of the type illustrated and described in U.S. Pat. No. 3,176,539.

As described in said U.S. Pat. No. 3,176,539, the brake mechanism comprises a chain drum 1 rotatable by a gear 2 which, preferably, is integral with the drum 1. The drum 1 is rotatably mounted on a shaft 3 which is secured to the housing back plate 4 and the housing 5 by bolts 6 and 6a threaded into the ends of the shaft 3. One end of a chain 7 is secured to the drum 1 by a pin 8, and the other end of the chain 7 is secured to the brake rigging on a vehicle, such as a railway car, in a conventional manner so that when the chain 7 is wound up on the drum 1, by reason of rotation of the latter, the brakes of the vehicle are applied to stop, or prevent movement of, the vehicle.

The teeth of a pinion gear 9, engage the teeth of the gear 2. Preferably, the gear 9 is integral with a gear 10 and a shaft 11, so that when the gear 10 is rotated, the gear 9 and the shaft 11 rotate which causes the gear 2 and the drum 1 to rotate. The shaft 11 is rotatably mounted in bearings 12 and 13 mounted on the back plate 4 and the housing 5.

The teeth of a pinion gear 14 engage the teeth of the gear 10 so that rotation of the gear 14 causes rotation of the gear 10. The gear 14 is freely rotatable on a shaft 15 when it is not held by a coupling 16 which is secured to the shaft 15 so as to rotate therewith. The shaft 15 is rotatable by a hand wheel 17 which is rotatably mounted on the back plate 4 and the housing 5 by bearings 18 and 19.

A detent or ratchet wheel 20 is mounted on the shaft 15 and cooperates with a clutch mechanism described in said U.S. Pat. No. 3,176,539 and with a pawl 21 in the manner described in said patent so that when the hand wheel 17 is rotated in the brake applying direction, the pinion gear 14 and the hand wheel 17 cannot rotate in the reverse direction under the tension of the chain 7. However, the brakes may be released, after application, in small increments by rotating the hand wheel 17 in the direction opposite to the brake applying direction.

As described in said patent, a crank 22 cooperates with a cam 23 on a manually pivotable shaft 24 so that when the shaft 24 is pivoted, the pinion gear 14 is released from the collar 16 and the pinion gear 14 can rotate freely on the shaft 15. Thus, if it is desired to release the brakes quickly after they have been applied, the shaft 24 is pivoted permitting the gear 14 to rotate, and thereby permitting rotation of the gears 2, 9 and 10 and the drum 1, under the tension of the chain 7.

The hand brake mechanism illustrated in the drawings differ from the hand brake mechanism illustrated and described in said U.S. Pat. No. 3,176,539 primarily in the addition of the intermediate gears 9 and 10 and of a brake means or governor hereinafter described, and the parts described hereinbefore operate and function as described in said patent. However, due to the addition of the intermediate gears 9 and 10, a braking force greater than the braking force which can be applied by the mechanism described in said patent, for the same amount of turning force applied to the wheel 17 and the hand wheel of said patent, can be applied to the vehicle brakes through the chain 7 and the brake rigging. Because the braking force is larger, the gears 2, 9, 10 and 14 rotate rapidly when the brakes are quickly released by pivoting of the shaft 24 and release of the gear 14, and such gears and the drum 1 are subjected to relatively large forces when they are suddenly stopped at the time that the chain 7 becomes completely unwound from the drum 1. It has been found that damage to the parts of the brake mechanism and the life cycle tests of the AAR can be met by retarding the rotation of the gears, and hence, reducing the speed of rotation of the gears and the drum 1, after there is a quick release of the brakes but after the braking force on the chain 7 has been substantially reduced.

Although other braking means may be employed, the preferred embodiment of the invention comprises a brake internally of the brake mechanism housing which is coupled to the gear 10 and which provides a limited braking force which varies its retarding force dependent upon the speed of rotation of the gear 10. Thus, such brake acts as a governor and increases the retarding force with an increase of the speed of rotation of the gear 10 from a negligible value when the speed of rotation is low to a larger value which has no significant effect on the speed of rotation when the hand brake is first released. Thus, when the gear 10 is rotated slowly, such as when it is being rotated by the hand wheel 17 to apply the vehicle brakes and when the brake rigging approaches full release, the retarding force is insignificant, but when the brake rigging and the parts are moving or rotating at a higher speed due to inertia and not the force on the chain applied by tension on the brake rigging, the retarding force is sufficient to reduce the speed of rotation of the hand brake parts.

The preferred embodiment of the braking means is illustrated in FIGS. 2–5 and comprises a hollow cylinder or braking drum 25 which is non-rotatably secured to the back plate 4, such as by means of a press fit. The drum 25 has a shaft 26 integral therewith, the shaft 26 having a groove 27 for receiving a retaining ring 28. The shaft 26 carries a cylindrical bearing 29 on which a gear 30 with a flange 31 having a plurality of wedge shaped slots 32 which are open at their radially outermost ends is rotatably mounted. As shown in FIG. 3, one radially extending side **32*a* of each slot is substantially parallel to but offset from a radius of the hollow cylinder or drum 25, and the opposite radially extending side 32*b* of each slot extends at an acute angle to said one side 32*a*. A plurality of brake shoes 33, one for each slot, are slidably received in, and substantially fill, the slots 32 between the collar 31 and the drum 25**.

The teeth of the gear 30 mesh with the teeth of the gear 10 so that, depending upon the gear ratios, the gear 30 rotates many times faster, e.g. approximately thirty-two times faster in the embodiment illustrated, than the drum 1 upon release of the vehicle brakes. Such rate of rotation of the gear 30 causes the shoe 33 to be thrown outwardly by centrifugal force against the inner wall of the drum 25. By reason of the friction between the shoes 33 and the inner wall of the drum 25, there is a braking force applied to the gear 10 which, after release of the hand brake and the braking force on the chain 7 is substantially reduced, reduces the speed of rotation of the gears 2, 9, 10 and 14 and the chain drum 1, as compared to the speed of rotation thereof in the absence of the gear 30, shoes 33 and drum 25. Also, because of the gear ratios, a smaller braking force is required for retarding the rotation of the chain drum 1 than would be the case if the braking force were applied directly to the chain drum 1, such as by way of the gear 2. However, the gear 30 could be driven by a gear in the gear train other than the gear 10.

As pointed out hereinbefore, the braking means in the hand brake applies a limited amount of braking force, i.e. a force insufficient to make any significant difference in the speed of rotation of the parts of the hand brake mechanism when a large force, e.g. the braking force which normally is in excess of 3000 lbs., is applied to the chain 7. Thus, said parts will rotate at a high speed, substantially unaffected by the braking means, when the brakes of the railway car are first released by pivoting of the shaft 24 and, therefore, the car brakes are quickly released. On the other hand, the amount of braking force applied by the braking means is sufficient, after the brakes are released, to slow the speed of rotation of such parts to a small value as the chain 7 approaches its full let-out position without preventing the chain 7 from reaching its full let-out position. In other words, even though the braking force applied by the braking means increases with the speed of rotation of the flange 31 and vice versa, the maximum braking force which the braking means can apply under conditions normally encountered, is insufficient to cause a significant retardation of the rotation of the hand brake parts until after the car brakes have released and the forces on such parts are merely inertia forces. For example, the braking force of the braking means becomes significant only when the force pulling the chain 7 is on the order of 700 lbs. or of 10% and less but not more than 30% and preferably, not more than 20% of the force applied to the chain 7 to set the car brakes, e.g. 3350 lbs. 4475 lbs. or 6800 lbs.

The retarding force on the hand brake parts is dependent upon the speed of rotation of the gear 30 and the dimensions, materials and finish of the shoes 33 and the braking drum 25. It has been found that a satisfactory construction of the braking means, which will cause the hand brake mechanism to meet the AAR requirements can be obtained with the following characteristics:

| | |
|---|---|
| ratio of gear 30 rotation speed to speed of rotation of chain drum 1 | approx. 32 |
| diameter of inner wall of braking drum | approx. 3.5 in. |
| material and finish of drum 25 | cold finish bar C1215 |
| outer end surface dimension of | approx. 0.453 in. thick |

-continued

| | |
|---|---|
| each shoe 33 | and $\frac{7}{8}$ in. in the circumferential direction |
| material of each shoe 33 | cast iron |
| radius of outer end surfaces of each shoe | 1-11/16 in. |

Figure 6:
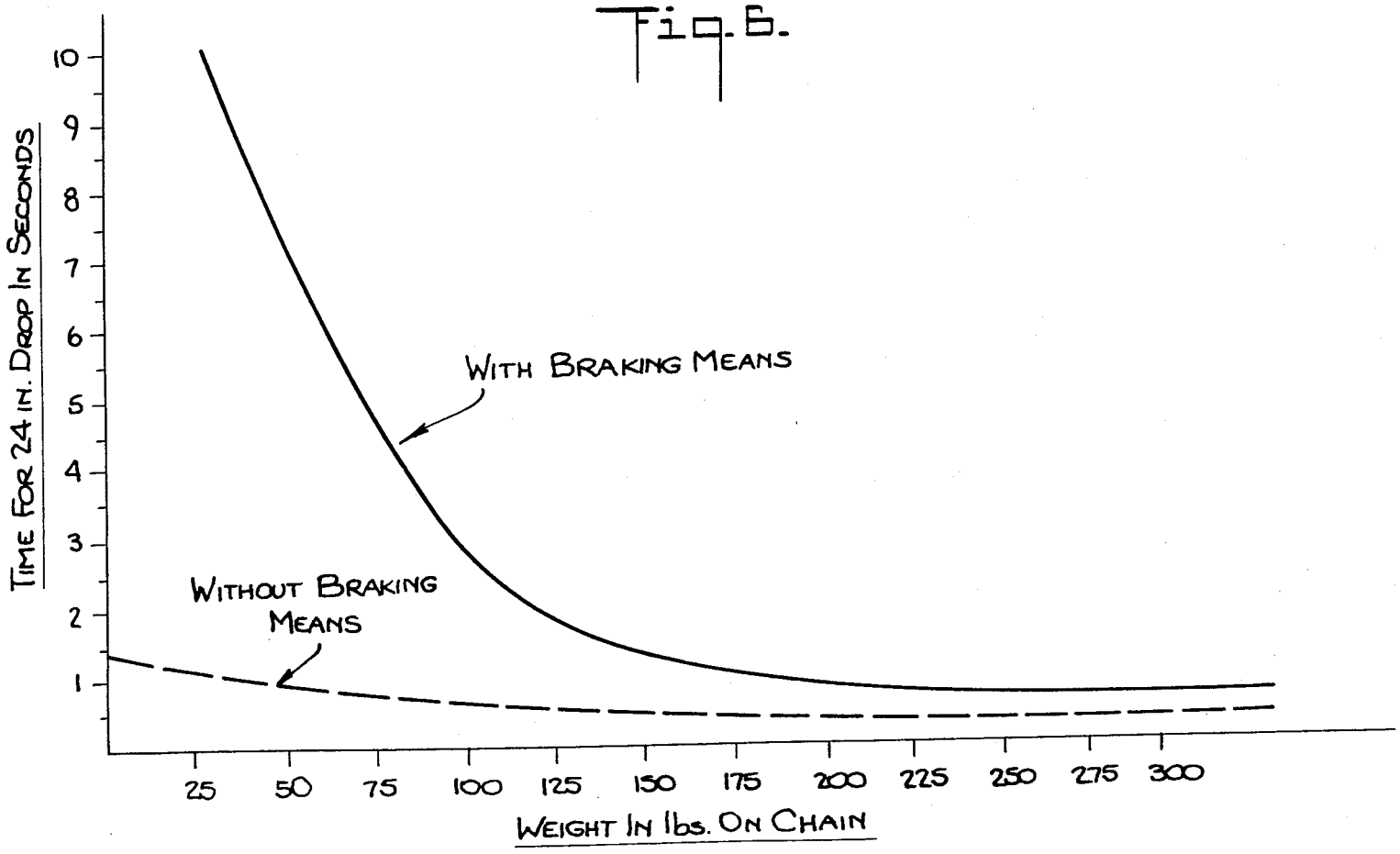
FIG. 6 is a graph illustrating the characteristics of the braking means in the hand brake of the invention.

With a hand brake having braking means having the construction set forth hereinbefore and providing the desired results, tests were performed with weights of various sizes attached to the chain 7. With each weight size, the time for the weight to drop through a distance of two feet was measured to determine the effect of the braking means on the time taken by each weight to drop through such distance. Similar tests with such weights and without such braking means were carried out. FIG. 6 is a graph showing the results of such tests, the solid line curve illustrating the results with the braking means in operation and the dashed line curve illustrating the results with the braking means inoperative. It will be observed from an examination of FIG. 6 that the braking means has little effect with respect to the dropping time of the weight when the weight is 300 lbs. or more, and the effect of the braking means increases exponentially when the weight is about 125 lbs. Thus, if the pulling force on the chain 7 exceeds 300 lbs., there is no significant retardation of the rotation speed of the hand brake parts whereas at pulling forces on the chain of less than 300 lbs., the braking means exerts a significant braking force in relation to the speed of rotation of such parts.

Of course, it will be apparent to those skilled in the art, that the desired results can be obtained with different ratios between the speed of rotation of the gear 30 and the chain drum 1, different materials and/or dimensions for the braking drum 25 and the shoes 33 and a different number of the shoes 33. Also, the shoes 33 could be differently mounted and actuated by other centrifugal force responsive means.

It is to be noted that since the shoes 33 press against the inner wall of the braking drum 25 with significant pressure only when the gear 30 rotates relatively rapidly and since the gear 30 is rotated only relatively slowly when the vehicle brakes are being applied by means of manual rotation of the hand wheel 17, the braking means of the invention does not apply any significant retarding force to the gears when the vehicle brakes are being applied.

It will also be observed that with the invention, it is not necessary to add any devices external to the hand brake housing to obtain the desired results.

Although preferred embodiments of the present invention have been described and illustrated, it will be apparent to those skilled in the art that various modifications may be made without departing from the principles of the invention.

What is claimed is:

1. A brake operating mechanism for the brakes of a vehicle which apply a variable load on said mechanism as the brakes are released comprising:

a rotatable, wind-up drum with means for connecting it to the brakes of said vehicle, said drum being rotatable in a wind-up direction for setting the brakes of said vehicle with a predetermined braking force on such connecting means and being rotatable in the opposite, unwinding direction for releasing said brakes of said vehicle, said drum having a brake setting position when it is wound-up in said wind-up direction and applies said predetermined braking force to said brakes and having a brake release position when it is unwound in said unwinding direction and said brakes are released;

a rotatable shaft;

drive means including a plurality of gears interconnecting said rotatable shaft and said rotatable, wind-up drum for causing rotation of said rotation of said rotatable, wind-up drum in said wind-up direction with rotation of said rotatable shaft and rotation of the gears in first directions;

detent means coupled to said rotatable shaft for preventing rotation thereof in a second direction and thereby, preventing rotation of said gears in second directions opposite to said first directions and preventing rotation of said wind-up drum in said opposite unwinding direction; and release means for disabling said detent means with respect to preventing rotation of said gears in said second directions; wherein the improvement comprises:

braking means coupled to one of said gears for applying a braking force which is sufficient to retard the rotation of said gears in said second direction when the force applied to said connecting means is less than about 30% of said predetermined braking force but which is insufficient to cause significant retardation of said rotation of said gears when said force applied to said connecting means is greater than about 30% of said predetermined braking force for thereby permitting said gears to rotate upon initial release of said release means at a rate which is substantially unaffected by said braking means but which is thereafter substantially reduced by said braking means and reduces wear on said gears and prevents damage to said brake operating mechanism during rotation of said gears in said second directions, said braking means being responsive to the rate of rotation of said one of said gears for applying a retarding force opposing rotation of said gears in said second directions which is independent of any force maintained on said release means, which is dependent upon the rate of rotation of said one of said gears and which increases with an increase in the rate of rotation of said one of said gears to a value which is insufficient to significantly retard the rate of rotation of said gears upon initial release of said release means and hence, of said wind-up drum in said unwinding direction, said braking means exerting insignificant rotation retarding action on said one of said gears when said one of said gears is rotated at a rate produced by manually rotating said shaft even when said release means is operated whereby said one gear is not retarded in rotation when said shaft is manually rotated to apply said brakes of said railway car and said brakes connected to said wind-up drum are fully released independently of said release means after it has been operated to disable said detent means.

2. A brake operating mechanism as set forth in claim 1 wherein said braking force is sufficient to retard rotation of said gears when the force applied to said connecting means is less than about 20% of said predetermined braking force but is insufficient to cause significant retardation of said gears when said force applied to said connecting means is greater than about 20% of said predetermined braking force.

3. A brake operating mechanism as set forth in claim 1 wherein said braking force is sufficient to retard rotation of said gears when the force applied to said connecting means is less than about 10% of said predetermined braking force but is insufficient to cause significant retardation of said gears when said force applied to said connecting means is greater than about 10% of said predetermined braking force.

4. A brake operating mechanism as set forth in claim 1 wherein said braking means comprises a braking member, a rotatable member coupled to and rotatable by said one of said gears, and a brake shoe movably mounted on said rotatable member and being movable into engagement with said braking member by reason of centrifugal force applied to said brake shoe with rotation of said rotatable member.

5. A brake operating mechanism as set forth in claim 4 wherein said braking member is a hollow cylinder and is mounted in a fixed position relative to said rotatable member, said rotatable member is mounted within said cylinder and has gear teeth engageable with the teeth of said one of said gears and said rotatable member has a plurality of radially extending slots, said brake shoe being received in one of said slots and further comprising additional brake shoes, said additional brake shoes being received in others of said slots, one shoe in each of said plurality of slots.

6. A brake operating mechanism as set forth in claim 5 wherein said plurality of gears have intermeshing teeth, one of said gears being secured to said wind-up drum for rotating the latter, and wherein the first-mentioned said one of said gears is other than said one of said gears secured to said wind-up drum.

7. A brake operating mechanism as set forth in claim 6 wherein said plurality of gears comprises a first gear connected to said rotatable shaft for rotation therewith by said release means, a second gear having its teeth intermeshing with the teeth of said first gear and a third gear secured to said second gear for rotation therewith, wherein said one of said gears secured to said wind-up drum has its teeth intermeshing with the teeth of said third gear and wherein the first-mentioned said one gear is said second gear.

8. A brake operating mechanism as set forth in claim 7 further comprising a housing and wherein said plurality of gears, said braking member and said rotatable member are mounted within said housing.

9. A brake operating mechanism as set forth in claim 4 wherein said braking member is a hollow cylinder and is mounted in a fixed position relative to said rotatable member, said rotatable member is mounted within said cylinder and has a radially extending slot open at its radially outermost end, said slot being wedge-shaped and having one radially extending side substantially parallel to but offset from a radius of said cylinder and having an opposite radially extending side which extends at an acute angle to said one radially extending side, and said brake shoe is received in and substantially fills said a slot.

10. A railway car installation comprising:

brake shoes engageable with the wheels of said car;

a rotatable, wind-up drum, said drum being rotatable in a wind-up direction for setting the brakes of said vehicle with a predetermined braking force and being rotatable in the opposite, unwinding direction for releasing said brakes of said vehicle, said drum having a brake setting position when it is wound-up in said wind-up direction and applies said predetermined braking force to said brakes and having a brake release position when it is unwound in said unwinding direction and said brakes are released;

brake rigging interconnecting said wind-up drum and said brake shoes, said rigging including pivotable levers;

means interconnecting one of said levers with said drum and windable around said drum to set said brakes;

a rotatable shaft;

drive means including a plurality of gears interconnecting said rotatable shaft and said rotatable, wind-up drum for causing rotation of said rotatable, wind-up drum in said wind-up direction with rotation of said rotatable shaft and rotation of the gears in first directions;

detent means coupled to said rotatable shaft for preventing rotation thereof in a second direction and thereby, preventing rotation of said gears in second directions opposite to said first directions and preventing rotation of said wind-up drum in said opposite unwinding direction; and release means for disabling said detent means with respect to preventing rotation of said gears in said second directions; wherein the improvement comprises:

braking means coupled to one of said gears for applying a braking force which is sufficient to retard the rotation of said gears in said second direction when the force applied to said connecting means is less than about 30% of said predetermined braking force but which is insufficient to cause significant retardation of said rotation of said gears when said force applied to said connecting means is greater than about 30% of said predetermined braking force for thereby permitting said gears to rotate upon initial release of said release means at a rate which is substantially unaffected by said braking means but which is thereafter substantially reduced by said braking means and reduces wear on said gears and prevents damage to said brake operating mechanism during rotation of said gears in said second directions, said braking means being responsive to the rate of rotation of said one of said gears for applying a retarding force opposing rotation of said gears in said second directions which is independent of any force maintained on said release means, which is dependent upon the rate of rotation of said one of said gears and which increases with an increase in the rate of rotation of said one of said gears to a value which is insufficient to significantly retard the rate of rotation of said gears upon initial release of said release means and hence, of said wind-up drum in said unwinding direction, said braking means exerting insignificant rotation retarding action on said one of said gears when said one of said gears is rotated at a rate produced by manually rotating said shaft even when said release means is operated whereby said one gear is not retarded in rotation when said shaft is manually rotated to apply said brakes of said railway car and said brakes connected to said wind-up drum are fully released independently of said release means after it has been operated to disable said detent means.

11. A brake operating mechanism as set forth in claim 10 wherein said braking force is sufficient to retard rotation of said gears when the force applied to said connecting means is less than about 20% of said predetermined braking force but is insufficient to cause significant retardation of said gears when said force applied to said connecting means is greater than about 20% of said predetermined braking force.

12. A brake operating mechanism as set forth in claim 10 wherein said braking force is sufficient to retard rotation of said gears when the force applied to said connecting means is less than about 10% of said predetermined braking force but is insufficient to cause significant retardation of said gears when said force applied to said connecting means is greater than 10% of said predetermined braking force.

13. A railway car brake operating mechanism for the brakes of a railway car which apply a variable load on the mechanism as the brakes are released comprising:

a rotatable, wind-up drum with means for connecting it to the brakes of said railway car, said drum being rotatable in a wind-up direction for setting the brakes of said railway car and being rotatable in the opposite, uwinding direction for releasing said brakes of said railway car;

a rotatable shaft;

drive means including a plurality of gears interconnecting said rotatable shaft and said rotatable, wind-up drum for causing rotation of said rotatable, wind-up drum in said wind-up direction with rotation of said rotatable shaft and rotation of the gears in first directions;

detent means coupled to said rotatable shaft for preventing rotation thereof in a second direction and thereby, preventing rotation of said gears in second directions opposite to said first directions and preventing rotation of said wind-up drum in said opposite unwinding direction; and release means for disabling said detent means with respect to preventing rotation of said gears in said second directions; wherein the improvement comprises:

braking means coupled to one of said gears for retarding the rotation of said gears in said second directions without significant retardation of the release of the brakes when said release means is operated for thereby reducing wear on said gears and preventing damage to said brake operating mechanism during rotation of said gears in said second directions, said braking means being responsive to the rate of rotation of said one of said gears for applying a retarding force opposing rotation of said gears in said second directions which is independent of any force maintained on said release means, which is dependent upon the rate of rotation of said one of said gears and which increases with an increase in the rate of rotation of said one of said gears whereby the rate of rotation of said gears in said second directions upon operation of said release means is less than the rate of rotation of said gears in said second directions in the absence of said braking means and is controlled by said braking means dependent upon the rate of rotation of said one of said gears, said braking means exerting insignificant rotation retarding action on said one of said gears when said one of said gears is rotated at a rate produced by manually rotating said shaft even when said release means is operated whereby said one gear is not retarded in rotation when said shaft is manually rotated to apply said brakes of said railway car and said brakes connected to said wind-up drum are fully released independently of said release means after it has been operated to disable said detent means, said braking means comprising a braking member in the form of a hollow cylinder, a rotatable member coupled to and rotatable by said one of said gears and mounted within said hollow cylinder, said hollow cylinder being mounted in a fixed position relative to said rotatable member and said rotatable member having a radially extending slot open at its radially outermost end, said slot being wedge-shaped and having one radially extending side substantially parallel to but offset from a radius of said cylinder and having an opposite radially extending side which extends at an acute angle to said one radially extending side, and a brake shoe movably mounted on said rotatable member in, and substantially filling, said slot and being movable into engagement with said hollow cylinder by reason of centrifugal force applied to said brake shoe with rotation of said rotatable member.

* * * * *